US006019125A

United States Patent [19]

Reverberi

[11] Patent Number: 6,019,125

[45] Date of Patent: Feb. 1, 2000

[54] VALVE UNIT FOR HIGH-PRESSURE PUMPS

[75] Inventor: Stefano Reverberi, Modena, Italy

[73] Assignee: Annovi E Reverberi S.R.L., an Italian Limited Liability Company, Modena, Italy

[21] Appl. No.: 09/153,855

[22] Filed: Sep. 16, 1998

[30] Foreign Application Priority Data

Oct. 8, 1997 [IT] Italy ..... RE97U0050 U

[51] Int. Cl.[7] ..... F16K 25/00

[52] U.S. Cl. ..... 137/454.6; 137/454.6; 137/543.19

[58] Field of Search ..... 137/454.4, 454.5, 137/454.2, 543.19, 543.21, 454.6

[56] References Cited

U.S. PATENT DOCUMENTS

| | | | |
|---|---|---|---|
| 1,691,449 | 11/1928 | Sharp | 137/543.19 |
| 2,090,512 | 8/1937 | Ernst | 137/543.21 |
| 2,366,004 | 12/1944 | Crittenden | 137/543.19 |
| 3,395,729 | 8/1968 | Temple | 137/543.19 |
| 3,478,774 | 11/1969 | Noakes et al. | 137/454.5 |
| 4,109,672 | 8/1978 | Szemeredi | 137/454.2 X |
| 4,331,176 | 5/1982 | Parkison | 137/454.5 |
| 4,532,958 | 8/1985 | Napolitano | 137/454.6 X |
| 4,679,584 | 7/1987 | Wolff | 137/543.19 X |
| 4,880,209 | 11/1989 | Bernat | 137/454.5 X |
| 4,936,339 | 6/1990 | Bennett | 137/454.6 |
| 5,207,242 | 5/1993 | Deghe et al. | 137/454.6 |
| 5,794,651 | 8/1998 | Miller | 137/454.5 |

FOREIGN PATENT DOCUMENTS

| | | | |
|---|---|---|---|
| 581052 | 9/1946 | United Kingdom | 137/454.4 |

*Primary Examiner*—Stephen M. Hepperle
*Assistant Examiner*—John Bastianelli
*Attorney, Agent, or Firm*—Birch, Stewart, Kolasch, & Birch, LLP

[57] ABSTRACT

Valve unit, particularly for high-pressure pumps, comprising a cage maintained in position by a screwed plug and containing a valve disc and a valve seat, the screwed plug having a threaded shank provided with an annular groove for a seal gasket in contact with the inner wall of the cavity which receives the valve unit, said annular groove for receiving said seal gasket being positioned adjacent to that end of said thread close to the valve unit, and being inserted into a portion of the plug receiving cavity having a diameter less than the outer diameter of the plug thread.

18 Claims, 2 Drawing Sheets

VALVE UNIT FOR HIGH-PRESSURE PUMPS

BACKGROUND OF THE INVENTION

1. Field of the Invention

This invention relates to high-pressure pumps, and more specifically to the intake and delivery valves thereof.

2. Description of Related Art

In high-pressure pumps the intake and pressurized fluid delivery valves are among the components subjected to greatest wear, and consequently require frequent replacement.

To facilitate this operation, the manufacturers of this type of pump make these valves accessible from the outside. In particular, they are inserted into a cylindrical chamber formed within the pump body and maintained in position by a retention plug, which also prevents fluid seepage to the outside of the pump.

The plug is subjected to a very high outward thrust, due to the liquid pressure which can reach more than 200 atmospheres, and is maintained in position by a thread.

A seal gasket positioned between said thread and the end of the plug provides the liquid seal.

With this type of arrangement, during pump operation the pressurized fluid necessarily wets the plug thread, giving rise to incrustation due to deposits from the pumped fluids, which make it difficult to unscrew the plug to replace the valve.

In addition the gasket seals about a diameter which is necessarily greater than the maximum diameter of the threaded part of the plug, with negative consequences on the thrust which the pumped liquid exerts on the plug.

SUMMARY OF THE INVENTION

The object of the invention is to obviate these and further drawbacks, and is attained by providing a valve unit, suitable for operation both on the delivery side and on the intake side, in which the seal means, namely the gasket, is provided at the end of the threaded part of the plug, in proximity to the valve unit, so as to prevent the pressurized liquid coming into contact with the plug thread.

This solution enables that cross-section of the retention plug exposed to the pressure of the pumped fluid to be reduced, with consequent thrust reduction and less stressing of the construction material of said retention plug.

It is to be understood the foregoing general description and the following detailed description is exemplary and explanatory and is intended to provide further explanation of the invention claimed.

BRIEF DESCRIPTION OF THE DRAWINGS

The constructional and functional characteristics of the invention will be more apparent from the ensuing description of a preferred embodiment thereof given by way of non-limiting example and illustrated on the accompanying drawings.

Figure 1:
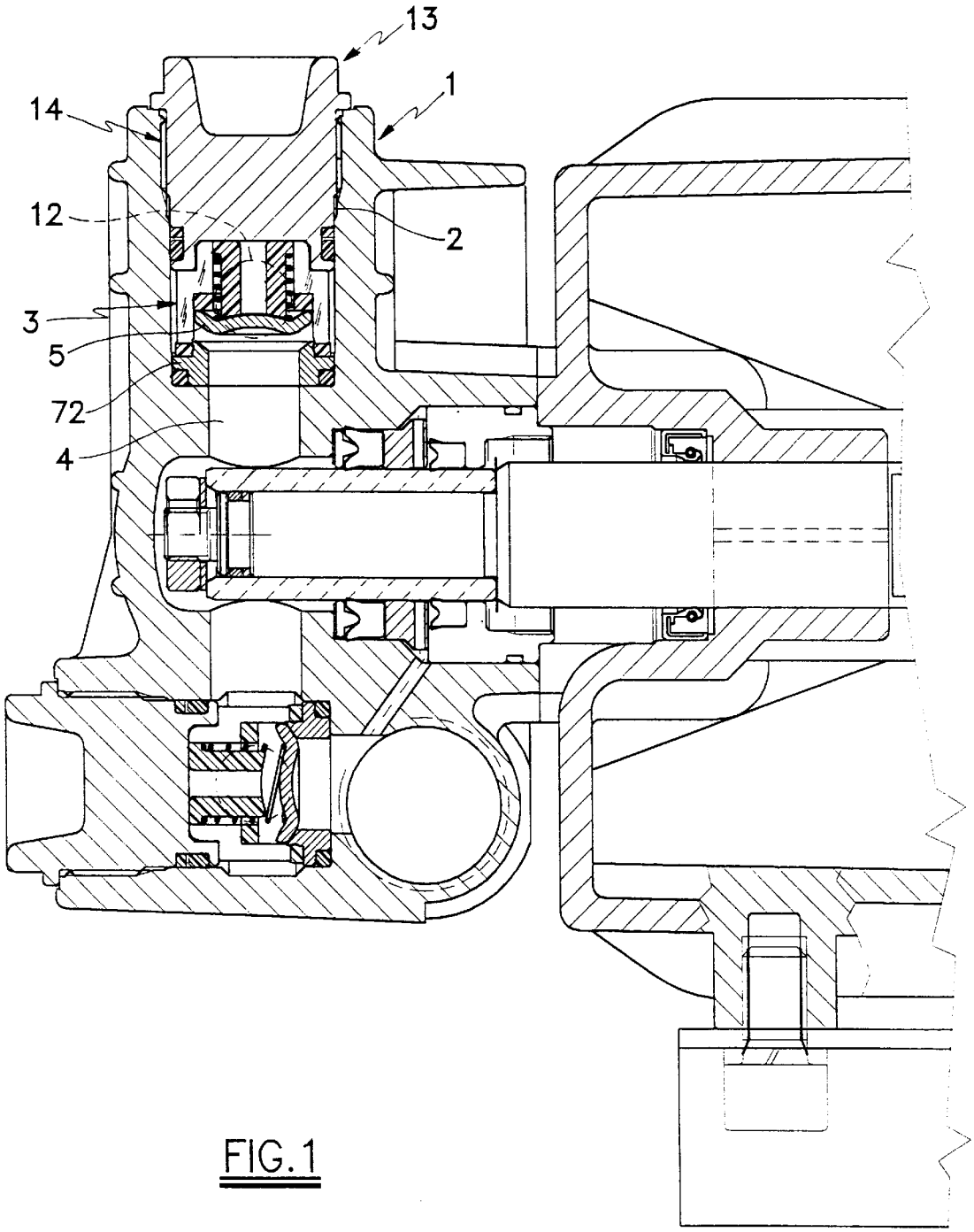
FIG. 1 is a section through the head of the pump according to the invention.
Figure 2:
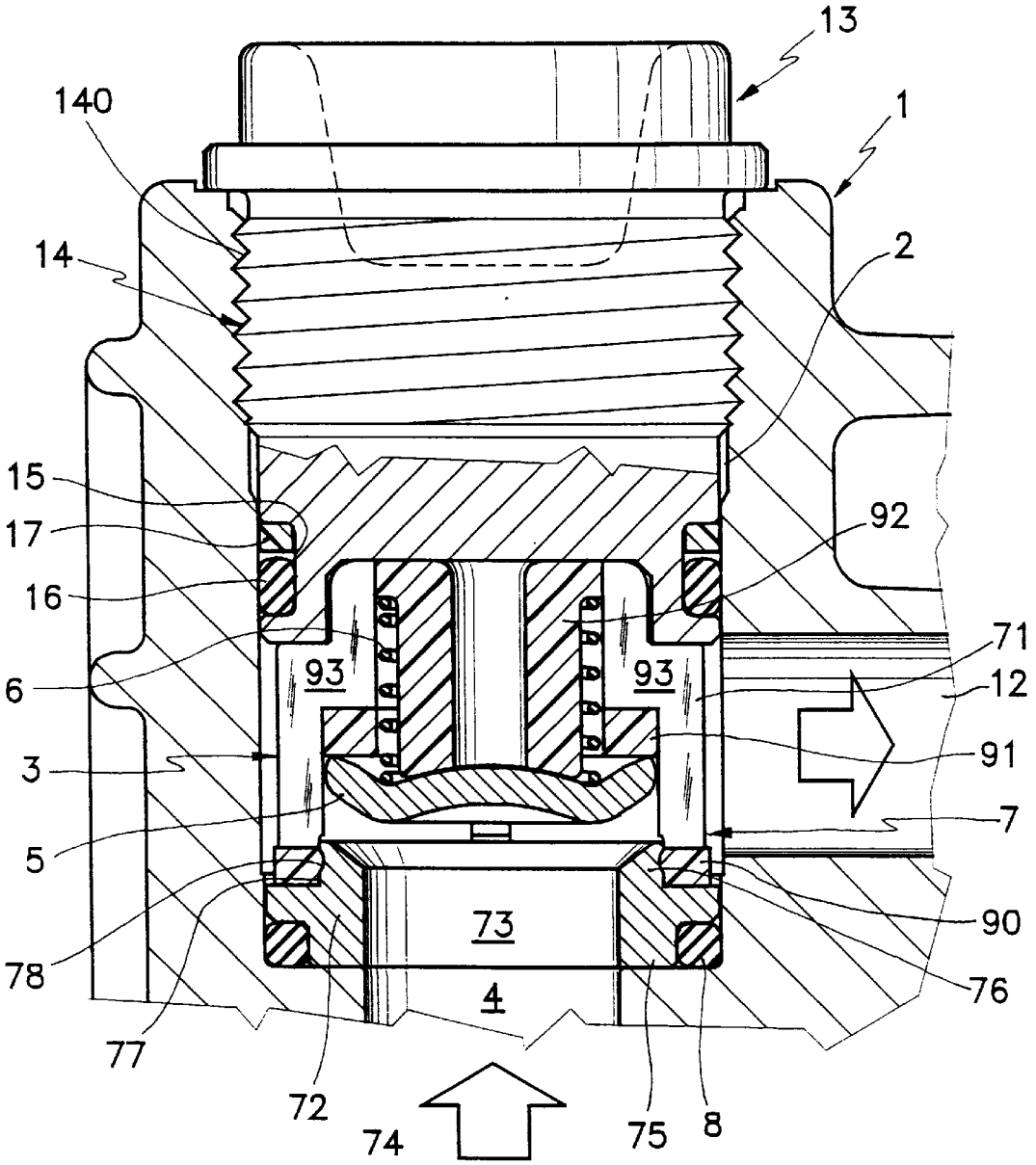
FIG. 2 is an enlarged cross-sectional view of the part comprising the delivery valve unit, which is identical to the intake valve unit.

The figures show the pump body 1 within which there is formed the cylindrical cavity 2, having three cross-sections of decreasing diameter in the direction of the valve 3, which is inserted as far as its base.

The base of the cylindrical cavity 2 communicates with the pressurized fluid feed conduit 4.

The valve 3 comprises the profiled valving element 5, which is maintained in the closure position by the spring 6.

The spring and valving element are contained in a cage-shaped valve body 7, which comprises an upper part 71 and a lower part 72 which is snap-inserted into the bottom of the upper part 71.

The upper part 71 is of synthetic resin construction, the lower part 72, of cylindrical shape, being of metal and provided with a through hole 73 coaxial with the longitudinal axis, through which the pressurized fluid is fed. Said through hole 73 has an upper enlargement 74 forming the valve seat. In addition, the lower part 72 is provided with a protuberance 75 to receive a gasket 8 of O-ring type, and an upper protuberance 76, in the vertical wall 77 of which there is provided a groove 78 for its snap-connection to the upper part 71.

As stated, said upper part 71 is in the shape of a cage of synthetic material construction, formed from a first ring 90 and a second ring 91 and a hollow central core 92, these being connected together by four equidistant profiled ribs 93.

The lower surface of the hollow central core 92 has a contour such as to adhere perfectly to the upper surface of the underlying profiled valving element 5.

Said profiled valving element 5 acts against the spring 6, and is guided by the four profiled ribs 93. In FIG. 1 it is in a position which enables pressurized fluid to pass and enter the cylindrical cavity 2 via the feed conduit 4, to leave it through the conduit 12.

The valve 3 is maintained in position by the overlying retention plug 13, the shank 14 of which has two different cross-sections. The first of said cross-sections is threaded to enable it to be fitted to the pump body 1, whereas the second has an annular groove 15 receiving a seal gasket 16 and a ring 17, preferably of teflon.

The presence of the seal gasket 16 downstream of the thread 140 prevents the pressurized liquid wetting the thread 140, so preventing the formation of incrustation.

It is also apparent that the position of the gasket 16, by virtue of the smaller surface area subtended by it, results in a reduction in the thrust exerted on the plug by the pressurized liquid by at least about 25%.

The aforegoing is also valid for the intake valve unit, shown in FIG. 1, which is constructionally identical to the delivery valve unit.

I claim:

1. A valve unit, comprising:

a housing having a cavity therein, said cavity including inlet and outlet ports;

a cage situated between said inlet and outlet ports, said cage including an upper part made of resin and a lower part made of metal, said upper part including a plurality of ribs and an annular protuberance, said lower part including an annular lip and an upper surface, said lower part assembled to said upper part by snap-fitting over said annular protuberance of said upper part;

a valve member disposed within said cage and being guided by said plurality of ribs;

a spring within said cage being used to maintain said valve member against said upper surface and being guided by said plurality of ribs; and a threaded retention plug threaded into said cavity of said housing.

2. The valve unit of claim 1, wherein said upper part further includes:

a first ring disposed between said valve member and said plurality of ribs and connected to an inner portion of said plurality of ribs;

a second ring connected to a bottom portion of said plurality of ribs; and a central core disposed within said cage and above said valve member and being guided by said plurality of ribs, said central core having a hollow portion formed therein.

3. The valve unit of claim 2, wherein said central core and said valve member have mating curved surfaces.

4. The valve unit of claim 1, wherein an upper portion of said upper part fits over a lower part of said retention plug.

5. A valve unit, comprising:

a housing having a cavity therein, said cavity including inlet and outlet ports;

a cage disposed in said cavity and including an upper part and a lower part, said upper and lower parts frictionally secured to each other, said upper part comprising a plurality of ribs, a first ring disposed between said valve member and said plurality of ribs and connected to an inner portion of said plurality of ribs, a second ring connected to a bottom portion of said plurality of ribs, and a central core disposed within said cage and above said valve member and being guided by said plurality of ribs, said central core having a hollow portion formed therein;

a valve member disposed within said cage; and a biasing member biasing said valve member towards said inlet port.

6. The valve unit of claim 5, wherein said first ring is made of resin.

7. The valve unit of claim 5, wherein said second ring is made of resin.

8. The valve unit of claim 5, wherein said central core is made of resin.

9. The valve unit of claim 5, wherein said second ring includes a non-constant radius inner wall to secure with said lower part.

10. The valve unit of claim 5, wherein said valve member and said central core have mating curved surfaces.

11. The valve unit of claim 5, wherein said lower part comprises:

an upper enlargement;

an annular upper protuberance to secure with said upper part;

a central annular lip; and an annular lower protuberance to receive a gasket.

12. The valve unit of claim 5, wherein said lower part is made of metal.

13. The valve unit of claim 5, further comprising a retention plug overlying said valve within said housing, said retention plug including a shank portion.

14. The valve unit of claim 13, wherein a lower part of said retention plug fits over an upper portion of said upper part.

15. The valve unit of claim 13, wherein said shank portion comprises:

a threaded portion fitting within said housing; and a second portion having an annular groove to receive a plug ring and a seal gasket, said plug ring disposed between said annular groove and said threaded cross-section, said seal gasket disposed between said annular groove and said plurality of ribs.

16. The valve unit of claim 15, wherein said plug ring is made of TEFLON (PTFE).

17. The valve unit of claim 5, wherein said cavity of said housing having a plurality of cross-sections of decreasing diameter toward said cage.

18. The valve unit of claim 1, wherein said retention plug includes a shank portion comprising:

a threaded portion that fits within said housing; and a second portion having an annular groove to receive a plug ring and a seal gasket, said plug ring disposed between said annular groove and said threaded cross-section, said seal gasket being disposed between said annular groove and said plurality of ribs.

* * * * *